US005355933A

United States Patent [19]

Voss

[11] Patent Number: 5,355,933

[45] Date of Patent: Oct. 18, 1994

[54] METHOD OF SQUEEZE CASTING METAL ARTICLES USING MELT-OUT METAL CORE

[75] Inventor: Karl D. Voss, West Bloomfield, Mich.

[73] Assignee: CMI International Inc., Southfield, Mich.

[21] Appl. No.: 150,846

[22] Filed: Nov. 12, 1993

[51] Int. Cl.[5] ..... B22C 3/00; B22C 9/10; B22D 29/00; B22D 18/02

[52] U.S. Cl. ..... 164/120; 164/132; 164/138

[58] Field of Search ..... 164/33, 72, 120, 132, 164/138

[56] References Cited

U.S. PATENT DOCUMENTS

| | | | |
|---|---|---|---|
| 1,544,930 | 7/1925 | Pack . | |
| 1,662,354 | 3/1928 | Williams . | |
| 1,710,534 | 4/1929 | Field . | |
| 2,609,576 | 9/1952 | Roush et al. . | |
| 3,258,816 | 7/1966 | Rearwin . | |
| 4,667,727 | 5/1987 | Barlow et al. | 164/97 |
| 4,712,600 | 12/1987 | Hamajima et al. | 164/97 |
| 4,774,990 | 10/1988 | Yamamoto et al. . | |
| 4,955,426 | 9/1990 | Akimoto et al. . | |
| 5,263,531 | 11/1993 | Drury et al. . | |

FOREIGN PATENT DOCUMENTS

| | | | |
|---|---|---|---|
| 48-32053 | 4/1973 | Japan . | |
| 51-36700 | 10/1976 | Japan | 164/132 |
| 52-14521 | 2/1977 | Japan . | |
| 53-46438 | 4/1978 | Japan . | |
| 63-183769 | 7/1988 | Japan . | |
| 63-199060 | 8/1988 | Japan . | |
| 3-294055 | 12/1991 | Japan | 164/138 |
| 455798 | 2/1975 | U.S.S.R. | 164/132 |
| 334714 | 9/1930 | United Kingdom . | |

OTHER PUBLICATIONS

An English translation of the Abstract is attached to the front of the following Japanese patents: JP52014521; JP63183769; JP63199060; JP73032053.

*Primary Examiner*—J. Reed Batten, Jr.

*Attorney, Agent, or Firm*—Reising, Ethington Barnard, Perry & Milton

[57] ABSTRACT

A melt-out zinc core is coated with insulating mica material and a graphite release agent and supported within a die cavity of a high pressure squeeze casting apparatus. Molten casting metal having a melting temperature above that of the core is injected into the die and then pressurized to about 15,000 psi to squeeze form the article in the die and around the core. The resultant article and core are then heated to above the melting temperature of the core and the core extracted from the article through cast-in outlet openings formed by the core. The insulating material and release agent are also extracted from the cast article by rinsing the cored passages of the cast article with water.

13 Claims, 2 Drawing Sheets

FIG-1
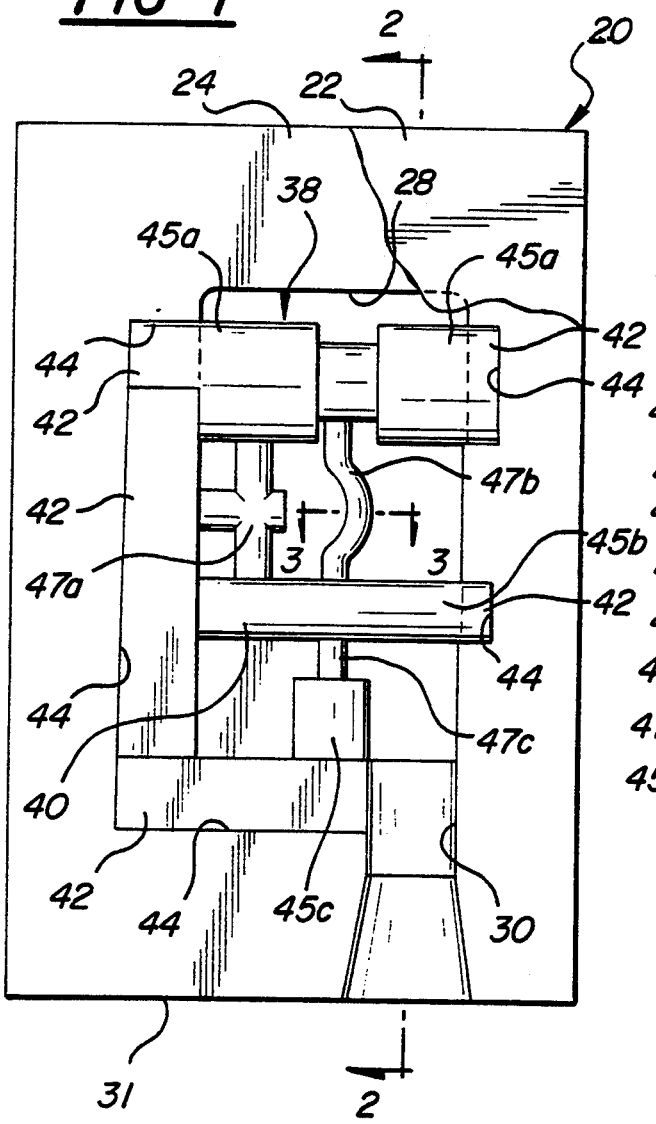
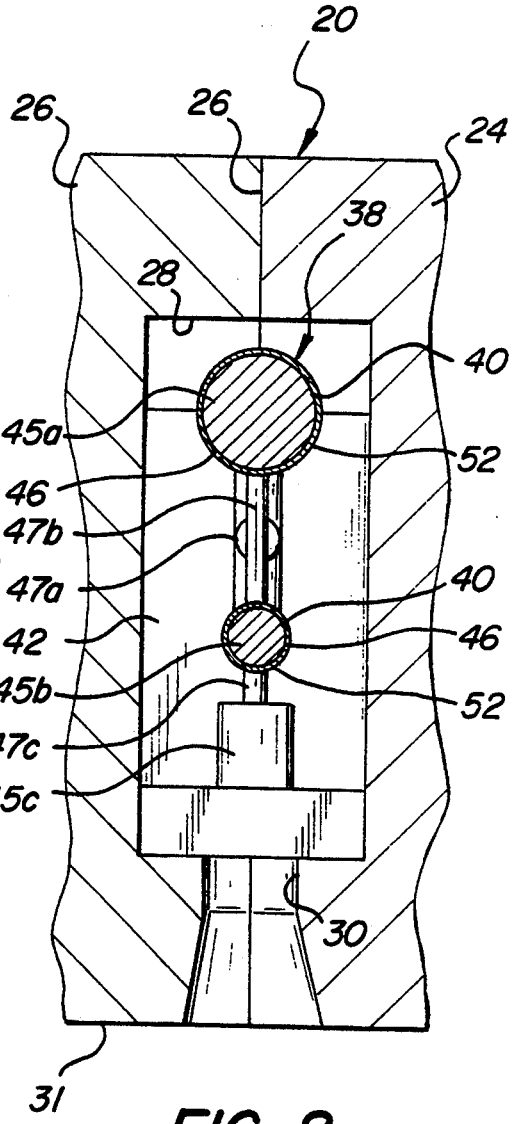
FIG-2
FIG-3
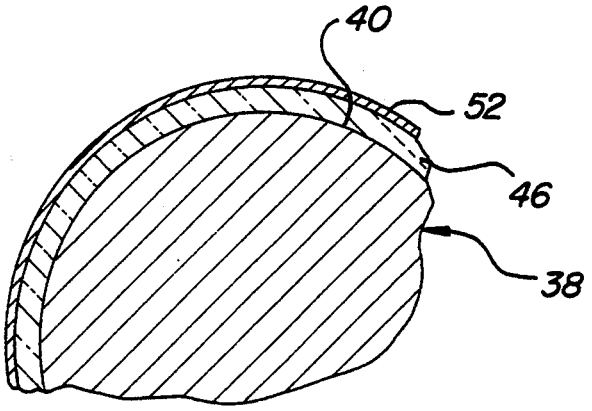

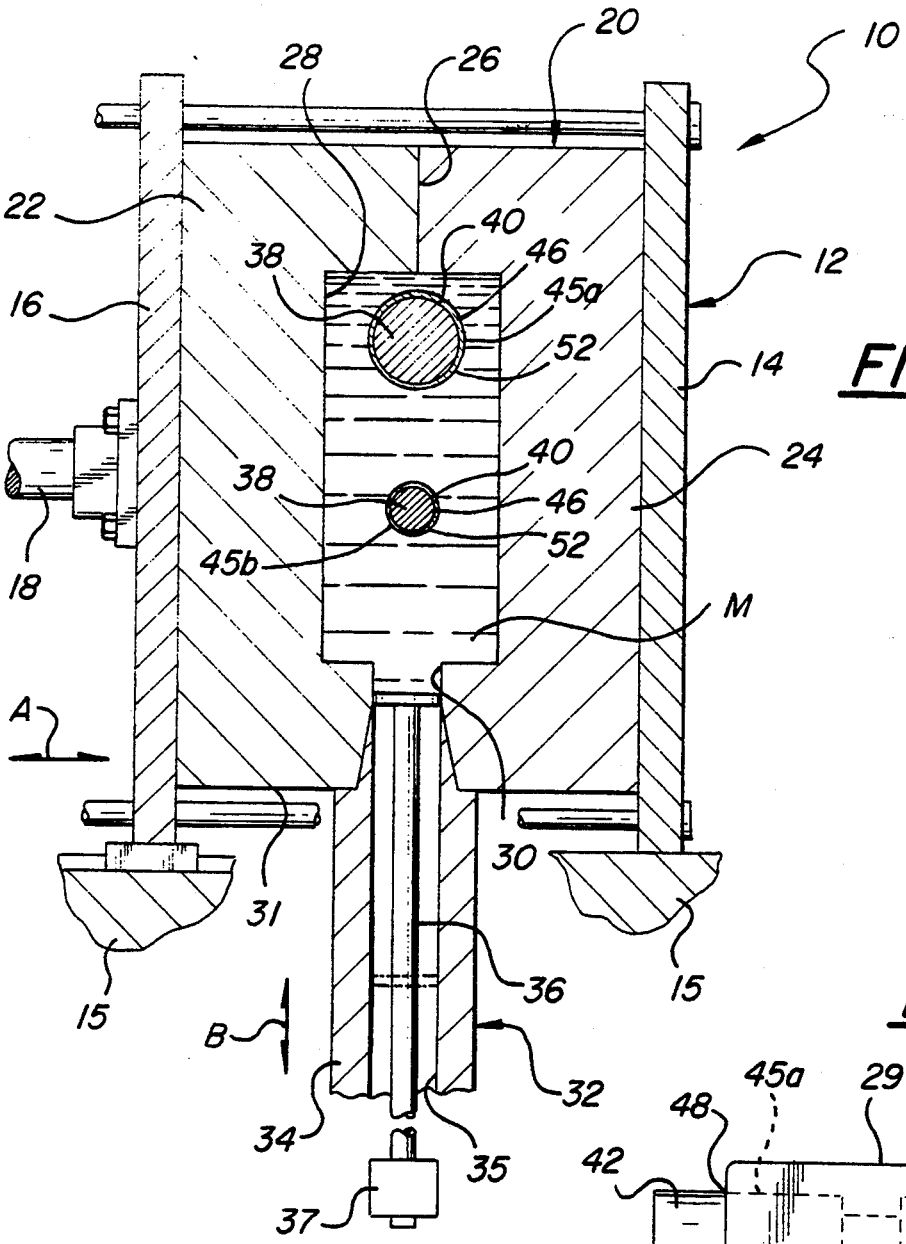
FIG-4
FIG-5
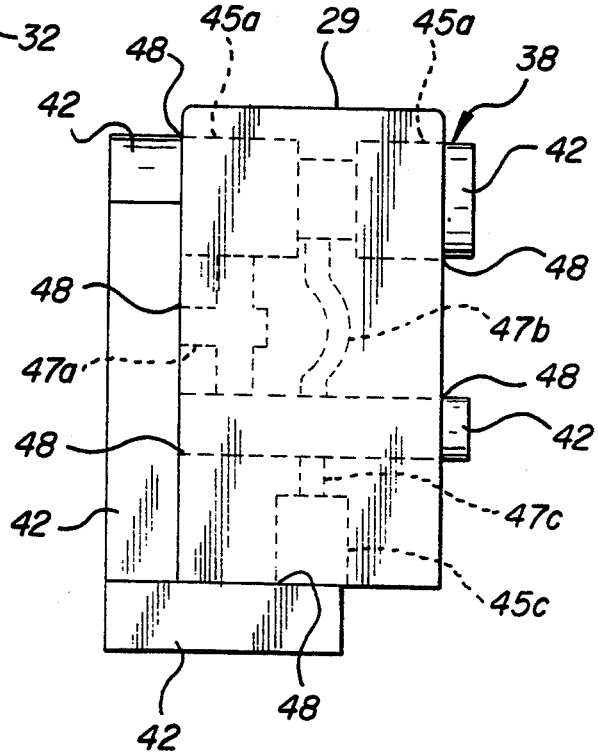
FIG-6
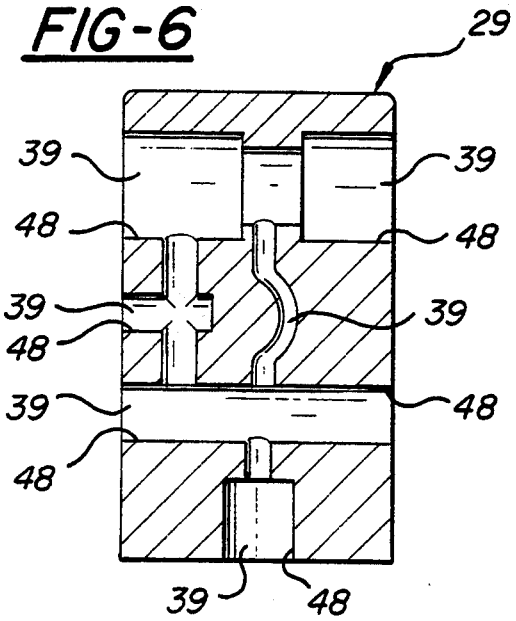

METHOD OF SQUEEZE CASTING METAL ARTICLES USING MELT-OUT METAL CORE

TECHNICAL FIELD

This invention relates generally to metal die casting and more particularly to a core construction and method of forming a cored space within an article produced by squeeze casting.

BACKGROUND OF THE INVENTION

It is known to produce various metal articles by a technique generally known as squeeze casting in which molten casting metal, usually aluminum or aluminum alloy material, is introduced into a die and a great amount of pressure exerted on the metal as it solidifies to essentially forge or squeeze-form the article in the die producing a metal article having lower porosity and improved mechanical properties as compared to the same article produced by more conventional lower pressure casting methods.

Difficulties have been encountered, however, in trying to squeeze cast articles having a configuration with re-entrant cavities or internal passages necessitating the use of a core. Because of the high pressures involved, conventional sand coring may not be used since the molten casting metal would penetrate the sand core. Similar difficulties are encountered with soluble salt cores. Salt cores are further susceptible to stress cracking during high pressure casting.

U.S. Pat. No. 4,712,600 proposes utilizing a melt-out metal core to produce an insulating air chamber and oil passage within a piston. The low melting point core metal is completely covered with a protective porous member. The molten casting metal penetrates the porous member causing the porous member to be embedded in the resultant article and further encapsulating the melt-out core within the article. To remove the core, a hole is drilled through the article to gain access to the core at which time the article and core may be heated and the core extracted from the article through the drilled hole. The porous member adds cost and complexity to the making of the article. Its incorporation into the article may not be permissible in some applications and could negatively affect the physical and mechanical properties of the cast article.

SUMMARY OF THE INVENTION AND ADVANTAGES

A method of producing a metal article by high pressure casting includes producing a low melting point melt-out metal core, applying protective insulating material to the core, inserting the insulated metal core into a die cavity of a high pressure casting die for preserving a space within the cavity corresponding to a cored space be formed within the cast article, introducing molten casting metal having a melting temperature relatively higher than that of the core metal into the die cavity and around the insulated metal core and pressurizing metal in the die cavity during solidification. The insulating material protects the metal core from the heat of the molten casting metal sufficiently to prevent the core from melting during casting. The casting metal is allowed to solidify in the die forming the resultant cored space and opening the die and removing the pressure cast article and insulating core from the die cavity, and wherein the article and core are heated to a temperature above the melting temperature of the core but below that of the casting metal to melt the metal core, and extracting the melted core and insulating material from the article leaving behind the resultant cored space within the article.

According to another aspect of this invention, a melt-out core construction is provided for placement within a die cavity of a high pressure squeeze casting die into which molten casting metal is introduced for producing a cast metal article. The core construction includes a metal core fabricated of low melting point metal material selected to have a melting temperature relatively lower than that of the casting metal and including an outer shape-imparting surface for producing a correspondingly-shaped cored space within the cast article. The melt-out core is extractable from the cast article by heating the core and article to a temperature above the melting temperature of the core metal. The core construction includes extractable insulating material disposed on at least a portion of the shape-imparting surface of the core for insulating the core from the heat of the molten casting metal sufficiently to prevent the core from melting during casting. The insulating material is extractable from the article following casting leaving behind the resultant cored space within the article.

The core construction and method of this invention provide a simple, low cost, and effective way of producing cored passages and other re-entrant spaces within a squeeze cast article. The melt-out metal core is of sufficient integrity to withstand the high pressures of squeeze casting and is readily extracted following casting. The insulating material protects the melt-out core from the heat of the molten casting metal and likewise is extracted following casting so as to not become embedded in the casting metal during formation of the article.

BRIEF DESCRIPTION OF THE DRAWINGS

These and other features and advantages of the invention will become more readily understood and appreciated by those skilled in the art when considered in connection with the following detailed description and drawings, wherein:

FIG. 1 is a fragmentary top view of a squeeze cast die assembly having a melt-out core constructed according to the present invention;

FIG. 2 is a fragmentary sectional view taken along lines 2—2 of FIG. 1;

FIG. 3 is an enlarged fragmentary sectional view of the core taken along lines 3—3 of FIG. 1;

FIG. 4 is a schematic sectional view of a squeeze casting apparatus supporting the die assembly of FIGS. 1 and 2;

FIG. 5 is a top view of the as-cast article and core assemblage; and

FIG. 6 is a sectional view of the article showing the resultant cored passageways produced upon extraction of the core.

DETAILED DESCRIPTION

A high pressure squeeze casting apparatus is shown schematically in FIG. 4 and designated generally by the reference numeral 10. The apparatus 10 includes a vertical die clamping unit 12 having a fixed platen 14 secured to a support base 15 and a movable platen 16 coupled to a hydraulic pressing ram 18 for advancing the movable platen 16 toward and away from the fixed platen 14 in conventional manner in the direction of double headed arrow A.

A casting die 20 is supported in the clamping unit 12 and includes left 22 and right 24 metal die halves mounted on the movable 16 and fixed 14 platens, respectively and joinable in mutual mating engagement along a vertical parting plane 26. The die halves 22, 24 have inner cavity walls defining an internal die cavity 28 therebetween. An ingate 30 extends from a bottom 31 of the die 20 vertically upward and into the die cavity 28 for admitting molten casting metal M into the die cavity 28 for producing a cast article 29 within the cavity 28.

The apparatus 10 also includes a casting metal injection unit 32 having a nozzle 34 movable toward and away from the die 20 along double headed arrow B for insertion or withdrawal with the ingate 30. The nozzle 34 has a reservoir 35 for holding a supply of the molten casting metal M to be injected into the cavity 28. An injection plunger 36 provides a false bottom to the reservoir 35 and is slidable along the length of the reservoir 35 from a lower position shown in phantom to a raised position (solid) toward the die 20 under the control of a hydraulic ram or other actuating means 37 for displacing and injecting the molten casting metal M into the die cavity 20 under relatively low pressure sufficient to move the metal into the die cavity 20 (e.g., 15–20 psi) and low velocity (e.g., 11.5 in/min) to initially fill the cavity 20 with the molten metal. The casting metal M is preferably aluminum-based material, such as 356 grade. The casting apparatus 10, including the die clamping unit 12 and the injection unit 32 is available commercially through Ube Industries, Limited, of Tokyo, Japan and is marketed under the trade name HVSC ® CASTING MACHINE.

A melt-out metal core 38 is provided for producing cast-in-cavities, passages, or other spaces 39 within the cast article 29. The melt-out core 38 is fabricated of a low melting point metal selected so as to have a melting temperature relatively lower than that of the casting metal being used to produce the cast article. One such low melting point core metal suitable for use with aluminum-based casting metal is zinc-based material. Zinc has a melting temperature of about 740° F., whereas the aluminum-based casting metal has a melting temperature of about 1,350° F.

The casting core 38 has an outer shape-imparting surface 40 corresponding generally to the cored space 39 to be formed within the cast article 29. The core 38 includes one or more core print projections 42 provided along the perimeter of the core 38 for supporting the core 38 within the cavity 28. The left and right die halves 22, 24 include corresponding core print recesses or depressions 44 inversely shaped to the core print projections 42. The core 38 is positioned with the die cavity 28 with the core print projections 42 seated within the core print depressions 44 of the die 20 externally of the die cavity 28, supporting the remaining portion of the core 38 within the die cavity 28 having the outer shape-imparting surface 40 exposed for preserving a space within the cavity 28 corresponding in size and shape to the cored space 39 to be formed within the cast article 29.

The die halves 22, 24 are clamped tightly together along the generally vertical parting plane 26 between the platens 14, 16 under a pressing force of 250 tons or more. As mentioned, the molten casting metal M is injected initially into the die cavity 28 at relatively low velocity and pressure introducing a slow, tranquil flow of casting metal M into the die cavity 28 to fill the cavity 28 with the molten metal M from below. The slow and tranquil fill minimizes flow turbulence and hence reduces entrainment of impurities and absorption of hydrogen by the molten casting metal M on introduction into the die cavity 28. As the molten casting metal M fills the die 20, the molten metal directly contacts the core 38, as illustrated in FIG. 4. The core 38 is initially at room temperature and as the molten casting metal contacts the core 38, a thin skin or shell of the casting metal solidifies around the core 38, protecting the core 38 against further direct contact from the molten metal M.

Once the die cavity 28 has been filled with the molten casting metal M, and as the molten casting metal M is solidifying in the die cavity 28, the pressure exerted on the casting metal M by the plunger 36 is sharply increased to 7000 to 15,000 psi causing the article 29 to be squeeze-formed in the die cavity 28 and around the core 38. Such high pressure squeezing essentially forges the article 29 in the die 20 closing any pockets of porosity that may form during solidification and increasing the mechanical properties of the final cast article, as compared to the same article produced by more conventional lower pressure casting techniques.

As the molten casting metal M solidifies, it transfers a certain amount of heat energy to the core 38 since the core 38 is at a lower temperature than the molten casting metal M and serves as a heat sink. The core 38 is designed to withstand the heat of the casting metal M without melting in the die 20 during casting and as such is able to accommodate the heat energy transferred to the core 38 from the molten casting metal M without raising the temperature of the core 38 to above its melting temperature. In some applications, the article being cast may have thin-walled sections and relatively large adjacent cavities to be formed in which case the associated large sections of core (e.g., those designated at **45*a*, 45*b*, 45*c* in the drawings) may have sufficient mass to absorb the heat energy of the molten casting metal M without causing unacceptably high temperature rise in the core metal temperature above its melting point. The initial shell of solidified casting metal against the outer surface 40 of the core serves to insulate the core 38 from the heat of the molten metal M to some extent. For cores having one or more relatively smaller sections (e.g., those designated at 47*a*, 47*b*, 47*c* in the drawings) surrounded by a relatively heavier section of the casting, the smaller core sections may be too small to absorb all of the heat transferred by the surrounding molten casting metal and would be susceptible to melting during casting. To protect these sections 47*a*, 47*b*, 47*c* against melting from exposure to the heat of the molten metal, the outer shape-imparting surface 40 of the core 38 is provided with insulating material 46 applied at least to the thin sections 47*a*, 47*b*, 47*c* and preferably to the entire outer surface of the core 38** of all sections.

The insulating material 46 is applied as a thin layer or coating to the outer surface of the core 38 and conforms substantially to the outer surface shape of the core and as such does not disturb to any significant extent the shape and size of the resultant cored space produced in the cast article. The insulating material 46 is nonporous and as such is not penetrated by the molten casting metal M during casting. The preferred material is mica applied with a thickness of about 0.01 to 0.03 inches, shown exaggerated in FIG. 3. The mica insulating material 46 is preferably applied as a dip coating by immersing the metal core 38 in a water-based solution of the mica material so as to coat the outer surface 40 of the core 38 with a thin layer of the mica material. The preferred mica dip coating material is available from Acme/Borden Corporation comprising a water based mica refractory premix slurry. One or more layers of the mica coating material 46 may be applied to achieve the desired thickness. The insulating layer 46 insulates the metal core 38 from the heat of the molten casting metal M sufficiently to prevent the core 38 from melting during casting of the article 29. In other words, the insulating layer 46 reduces the amount of heat energy transferred to the metal core 38 from the molten casting metal M to a level where even the thin portions of the core 38 can absorb the reduced transfer of heat energy without having the temperature of the core metal rise above its melting temperature during casting.

The insulating coating 46 is applied before inserting the core 38 into the die cavity 28. The core 38 is preferably preheated to a temperature below its melting point (e.g., 180° F.) before coating the outer surface of the core 40 with the insulating material 46. The coated core is then dried at an elevated temperature (e.g., 180° F.) to drive off the water carrier producing the solid substantially impermeable barrier mica coating 46 on the outer surface 40 of the core 38. The molten casting metal M thus does not extend beyond the insulating layer 46 into contact with the metal core 38 during casting.

Once the molten casting metal M has solidified in the die cavity 28 to produce the resultant cast article 29, the die halves 22, 24 are parted to open the die cavity 28 and the cast article 29 and core 38 assemblage (shown in FIG. 5) is removed from the die cavity 28. The core print projections 42 extend out of the casting beyond the perimeter of the cast article 29 providing at least one cast-in outlet opening 48 in the article 29 through which the metal core 38 may be extracted from the article 29. Following casting, the article 29 and core 38 assemblage are heated in an oven or by other means to a temperature above the melting temperature of the core metal 38 but below the melting temperature of the casting metal M causing the core metal to melt and allowing it to be extracted out of the cast article 29 through the outlet openings 48. The extracted core metal may be recovered for reuse.

The insulating layer 46 is also extracted from the article 29 following casting. The mica coating 46 is frangible and may be removed, at least in part, during extraction of the core 38. Any remaining mica material 46 may be removed by immersing the cast article 29 in warm water or otherwise rinsing the article with water to loosen the mica allowing it to be extracted from the article 29 through the outlet openings 48.

To assist in the release of the mica material 46 from the cored passages or spaces 39 formed in the cast article 29, lubricating release agent material 52 is preferably applied to the exposed outer surface of the insulating layer 46 before disposing the core 38 in the die cavity 28 in an amount sufficient to provide adequate lubrication between the insulating layer 46 and the casting metal M to release the insulating layer 46 from the cast article 29 following casting. The release agent material 52 should be one that does not readily adhere to the molten casting metal M providing a nonstick barrier between the casting metal M and insulating material 46. The preferred release agent material is graphite.

The graphite 52 may be applied as a superficial coating by preparing a solution bath of alcohol carrier and graphite and immersing the insulated core into the graphite bath causing a small amount of graphite to adhere to the mica coating. Upon withdrawing the core from the graphite bath, the alcohol is quickly driven off leaving behind the thin superficial graphite coating on the outermost surface of the core 38 during casting. The insulated core may be heated before and/or after immersing the core in the graphite bath to accelerate evaporation of the alcohol carrier.

The molten casting metal M comes into direct contact with the graphite layer 52 and quickly solidifies forming the aforementioned skin of casting metal against the core 38. The graphite layer 52 serves as a non-stick surface keeping the casting metal M from directly contacting the insulating mica layer 46 preventing cohesion therebetween.

The graphite layer 52 is also extracted from the cast article 29 following casting through the outlet openings 48. Some of the graphite material may come out with the extraction of the core 38. Any graphite material 52 not extracted from the cast article 29 with the core 38 is rinsed out of the article 29 in the aforementioned warm water bath, leaving behind the resultant cored passageways 39 in the cast article 29, as shown in FIG. 6, free from any core material, insulating material and substantially free of any release agent material.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims wherein reference numerals are merely for convenience and are not to be in any way limiting, the invention may be practiced otherwise than as specifically described.

I claim:

1. A method of producing a metal article by high pressure casting, comprising the steps of:

producing a melt-out metal core (38) having an outer shape-imparting surface (40) and a predetermined melting temperature;

applying water-extractable insulating material (46) to the outer shape-imparting (40) surface of the core (38);

inserting the insulated metal core (38) into a die cavity (28) of a high pressure casting die (20) having the outer surface (40) of the insulated core (38) exposed for preserving a space within the cavity (28) corresponding to a cored space (39) to be formed within the cast article (29);

introducing molten casting metal (M) having a melting temperature relatively higher than the melting temperature of the core metal into the die cavity (28) and against the insulated metal core (38) and pressurizing the metal (M) with pressure sufficient to squeeze form the article (29) in the die (20) and around the insulated core (38), the insulating material (46) protecting the meal core (38) from the heat of the molten casting metal (M) sufficiently to prevent melting of the core (38) during the casting of the article (29);

allowing the molten casting metal (M) to solidify in the die cavity (28) and about the insulated core (38) forming the resultant cored space (39) in the article (29) and opening the die (20) and removing the cast article (29) and insulated core (38) from the die cavity (28); and extracting the core (38) from the article (29) in a first step by heating the article (29) and core (38) in an oven to a temperature above the melting temperature of the core metal but below that of the casting metal (M) to liquify and extract the metal core (38) and thereafter introducing water into the cored space in a separate second step to dissolve and extract the insulating material (46) from the article (29).

2. The method of claim 1 including applying water-extractable mica to the outer surface (40) of the core (38) as the insulating material (46).

3. The method of claim 2 including dipping the core (38) in a bath of mica solution to coat the core (38) with the mica.

4. The method of claim 3 including preheating the core (38) before dipping the core (38) in the mica solution.

5. The method of claim 1 including applying a water-extractable lubricating release agent material (52) over the insulating material (46) before introducing the molten casting metal (M) into the die cavity (28) and extracting the release agent material (52) from the article (29) following casting with application of the water.

6. The method of claim 5 including applying a coating of graphite to the insulating material (46) as the release agent material (52).

7. The method of claim 6 including dipping the insulated core (38) into a bath of graphite solution to apply the graphite coating (52) to the insulating material (46).

8. The method of claim 1 including supporting at least a portion (42) of the core (38) outside of the die cavity (28) for forming at least one cast-in outlet opening (48) in the article (29), and extracting the liquified core metal and insulating material (46) from the article (29) through the outlet opening (48).

9. The method of claim 1 wherein the casting metal comprises aluminum-based metal.

10. The method of claim 1 wherein the core metal comprises a zinc-based metal.

11. The method of claim 1 including recovering the extracted core metal for reuse.

12. The method of claim 1 including pressurizing the casting metal in the die (20) to at least 7,000 psi during solidification of the casting metal.

13. The method of claim 1 including pressurizing the casting metal in the die (20) to 15,000 psi during solidification of the casting metal.

* * * * *

UNITED STATES PATENT AND TRADEMARK OFFICE

CERTIFICATE OF CORRECTION

PATENT NO. : 5,355,933
DATED : Oct. 18, 1994
INVENTOR(S) : KARL D. VOSS

It is certified that error appears in the above-identified patent and that said Letters Patent is hereby corrected as shown below:

In column 6, line 56, after "metal (M)", insert -- in the die cavity (28) during solidification of the casting metal (M) -- .

Signed and Sealed this

Twenty-first Day of February, 1995

Bruce Lehman

*Attest:*

BRUCE LEHMAN

*Attesting Officer*

*Commissioner of Patents and Trademarks*